US006587666B2

(12) United States Patent
Kato et al.

(10) Patent No.: US 6,587,666 B2
(45) Date of Patent: Jul. 1, 2003

(54) PROCESS UNIT WITH CLEANER AND IMAGE FORMING APPARATUS COMPRISING THE SAME

(75) Inventors: Tomoyuki Kato, Mishima (JP); Satoshi Itaya, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/950,135

(22) Filed: Sep. 10, 2001

(65) Prior Publication Data

US 2002/0031385 A1 Mar. 14, 2002

(30) Foreign Application Priority Data

Sep. 11, 2000 (JP) ..... 2000-275291

(51) Int. Cl.[7] ..... G03G 21/00
(52) U.S. Cl. ..... 399/350
(58) Field of Search ..... 399/350, 349, 399/351

(56) References Cited

U.S. PATENT DOCUMENTS 5,678,151 A * 10/1997 Miyashiro et al. ..... 399/303
6,219,523 B1 4/2001 Kobayashi

FOREIGN PATENT DOCUMENTS

JP 57-158871 * 9/1982
JP 10-268724 * 10/1998
JP 11-30927 A 2/1999

* cited by examiner

*Primary Examiner*—Quana M. Grainger
(74) *Attorney, Agent, or Firm*—Frishauf, Holtz, Goodman & Chick, P.C.

(57) ABSTRACT

An image forming apparatus includes a recording paper conveyor, a photosensitive drum, a charger, an exposure, a developer with toner, a transfer, and a cleaner. A process unit has the photosensitive drum and the cleaner in which a blade scrapes a residual toner from the drum, a paddle rotates to move the toner from the drum, and a scraper scraping the toner carried by the arm by its free end which is disposed radially outwardly and near to a rotation locus drawn by a radially directional outer end of an arm of the paddle during a rotation of the paddle.

24 Claims, 4 Drawing Sheets

PROCESS UNIT WITH CLEANER AND IMAGE FORMING APPARATUS COMPRISING THE SAME

CROSS-REFERENCE TO RELATED APPLICATIONS

This application is based upon and claims the benefit of the priority from the prior Japanese Patent Application No. 2000-275291, filed on Sep. 11, 2000; the entire contents of which are incorporated herein by reference.

BACKGROUND OF THE INVENTION

1. Field of the Invention

The present invention relates to a process unit with a cleaner and an image forming apparatus comprising the same.

2. Description of the Related Art

An electrophotographic image forming apparatus which comprises a conveyor for conveying recording papers and an image forming mechanism for forming a desired image on a recording paper conveyed by the conveyor is well known. The image forming mechanism includes a rotatable photosensitive drum, a charger for charging an outer circumferential surface of the photosensitive drum, an exposure device for forming a desired electrostatic latent image on the charged outer circumferential surface of the photosensitive drum, a developing device for developing the electrostatic latent image on the outer circumferential surface of the photosensitive drum with toner to form a toner image, a transfer device for transferring the toner image formed on the outer circumferential surface of the photosensitive drum to a recording paper being conveyed by the conveyor, and a cleaner for removing toner remaining on the outer circumferential surface of the photosensitive drum after transferring the toner image from the outer circumferential surface of the photosensitive drum to the recording paper being conveyed.

In recent years, electrophotographic image forming apparatuses have been sold in which the conveyor and various devices included in the image forming mechanism are arranged for reducing an area on a floor required to place each of the image forming apparatuses thereon. In this kind of image forming apparatus, the conveyor is arranged to convey recording papers upward from the vicinity of the floor. And, this kind of image forming apparatus is called as a vertical recording-paper conveyance type image forming apparatus. In the vertical recording-paper conveyance type image forming apparatus, a conveyance path of recording papers extends from a lower end portion to an upper end portion of the apparatus, and the photosensitive drum and the transfer device of the image forming mechanism are provided in both sides of the conveyance path. Further, in the side of the conveyance path where the photosensitive drum is provided, the cleaner, the charger, the exposure device and the developing device are provided in this order around the outer circumferential surface of the photosensitive drum from an upper side of the drum to a lower side thereof. The rotation direction of the photosensitive drum is the same as the conveying direction of the recording paper on the conveyance path to which the photosensitive drum faces.

In the vertical recording-paper conveyance type image forming apparatus, therefore, the cleaner is provided in the upper side of the outer circumferential surface of the photosensitive drum, to be adjacent to the outer circumferential surface. The cleaner includes a residual toner scraping blade pressed against an upper portion of the outer circumferential surface of the photosensitive drum. Therefore, residual toner scraped off by the blade from the upper portion of the outer circumferential surface of the rotating photosensitive drum stays at the upper portion of the outer circumferential surface of the rotating photosensitive drum by the action of gravity.

The cleaner in the conventional vertical recording-paper conveyance type image forming apparatus has a paddle which rotates near the tip end of the scraping blade and a storage container for scraped residual toner. The paddle cyclically move the scraped residual toner which stays on the upper portion of the outer circumferential surface of the rotating photosensitive drum to a portion distant from the upper portion of the outer circumferential surface of the photosensitive drum in the storage container.

However, when an amount of the scraped residual toner attached on the paddle gradually increases by the use of the paddle for a long time period, a moving efficiency of the scraped residual toner by the paddle is lowered, and the amount of the scraped residual toner stayed on the upper portion of the outer circumferential surface of the photosensitive drum increases.

As a result of this, the scraped residual toner leaks from the cleaner in some cases. Further, paper particles sticking to the outer circumferential surface of the photosensitive drum from recording papers, products generated by corona discharge in a case of using corona discharge in the charger and/or transfer device and sticking to the outer circumferential surface of the photosensitive drum, and any other objects sticking to the outer circumferential surface of the photosensitive drum, together with the scraped residual toner, are also scraped off from the outer circumferential surface of the photosensitive drum by the blade and stay on the upper portion of the outer circumferential surface of the photosensitive drum.

In order to prevent the above described moving efficiency from lowering, it has been also performed that a free end of a scraper is made in contact with a surface of the paddle at a position apart from the upper portion of the outer circumferential surface of the photosensitive drum. The free end of the scraper being in contact with the surface of the paddle scrapes the scraped residual toner attached to the surface of the paddle from the surface of the paddle. The scraped residual toner scraped from the surface of the paddle at the above described apart position is discharged to an outside of the cleaner by well known discharging means.

The scraper making in the sliding contact with the surface of the paddle, however, not only generates noise by the above described sliding contact, but also abrades the free end of the scraper and the surface of the paddle. The abrasion of the surface of the paddle causes a lowering of the above-described moving efficiency.

The present invention has been derived from the above-described circumstances, an object of the present invention is to provide a process unit with a cleaner, including a blade which scrapes residual toner from an upper portion of an outer circumferential surface of a photosensitive drum, and a paddle which feed cyclically scraped residual toner to a position distant from the upper portion of the outer circumferential surface of the photosensitive drum, the process unit with a cleaner being capable of efficiently feeding the scraped residual toner from the upper portion of the outer circumferential surface of the photosensitive drum to the above-described position distant from the upper portion for a long period, capable of reducing an amount of the scraped residual toner stayed on the upper portion of the outer circumferential surface of the photosensitive drum, and further capable of reducing noise occurring with an operation of the process unit with a cleaner.

Moreover, an object of the present invention is to provide an image forming apparatus comprising the process unit with a cleaner as described above.

BRIEF SUMMARY OF THE INVENTION

In order to achieve the object of the present invention as described above, a process unit with a cleaner, according to the present invention, comprises:

a photosensitive drum which is rotatable and has an outer circumferential surface on which toner is to be sticked; and a cleaner which removes toner sticking on the outer circumferential surface of the photosensitive drum, the cleaner including a blade which scrapes the toner sticking on the outer circumferential surface of the photosensitive drum from the outer circumferential surface, a paddle which has a rotation center and at least one arm projecting outward from the rotation center in a radial direction of the rotation center, rotates in a predetermined direction at a position near a toner scraping position by the blade on the outer circumferential surface of the photosensitive drum, and moves cyclically the scraped toner scraped from the outer circumferential surface of the photosensitive drum by the blade, from the toner scraping position, and a scraper which is provided in a side of the paddle opposite to the outer circumferential surface of the photosensitive drum and has a free end disposed radially outwardly and near to a rotation locus drawn by a radially directional outer end of the arm of the paddle during a rotation of the paddle, the free end scraping the scraped toner carried by the arm of the paddle rotated to the opposite side during the rotation of the paddle.

In order to achieve the object of the present invention as described above, an image forming apparatus according to the present invention, comprises:

a conveyor which conveys a recording paper;

a photosensitive drum which rotates in a predetermined direction;

a charger which charges an outer circumferential surface of the photosensitive drum;

an exposure device which forms a desired electrostatic latent image on the charged outer circumferential surface of the photosensitive drum;

a developing device which develops the electrostatic latent image by toner and forms a toner image;

a transfer device which transfers the toner image formed on the outer circumferential surface of the photosensitive drum, to the recording paper being conveyed by the conveyor; and a cleaner which removes the toner sticking on the outer circumferential surface of the photosensitive drum, after transferring the toner image from the outer circumferential surface of the photosensitive drum to the recording paper being conveyed by the conveyor, the cleaner being provided adjacent to the outer circumferential surface of the photosensitive drum, and the cleaner including:

a blade which scrapes the toner sticking on the outer circumferential surface of the photosensitive drum from the outer circumferential surface;

a paddle which has a rotation center and at least one arm projecting outward from the rotation center in a radial direction of the rotation center, rotates in a predetermined direction at a position near a toner scraping position by the blade on the outer circumferential surface of the photosensitive drum, and moves cyclically the scraped toner scraped from the outer circumferential surface of the photosensitive drum by the blade, from the toner scraping position; and a scraper which is provided in a side of the paddle opposite to the outer circumferential surface of the photosensitive drum, and has a free end disposed radially outwardly and near to a rotation locus drawn by a radially directional outer end of the arm of the paddle during a rotation of the paddle, the free end scraping the scraped toner carried by the arm of the paddle rotated to the opposite side during the rotation of the paddle.

BRIEF DESCRIPTION OF THE DRAWINGS

The accompanying drawings, which are incorporated in and constitute a part of the specification, illustrate various embodiments, and together with the general description given above and the detailed description of the embodiments given below, serve to explain the principles of the invention.

Hereinafter, an image forming apparatus comprising a process unit with a cleaner, according to an embodiment of the present invention, a main portion of a cleaner, according to each of the embodiment of the present invention and another embodiment of the present invention, and a main portion of a paddle used in a cleaner, according to still another embodiment of the present invention, will be described in detail with reference to the attached drawings.

DETAILED DESCRIPTION OF THE INVENTION

Figure 1:
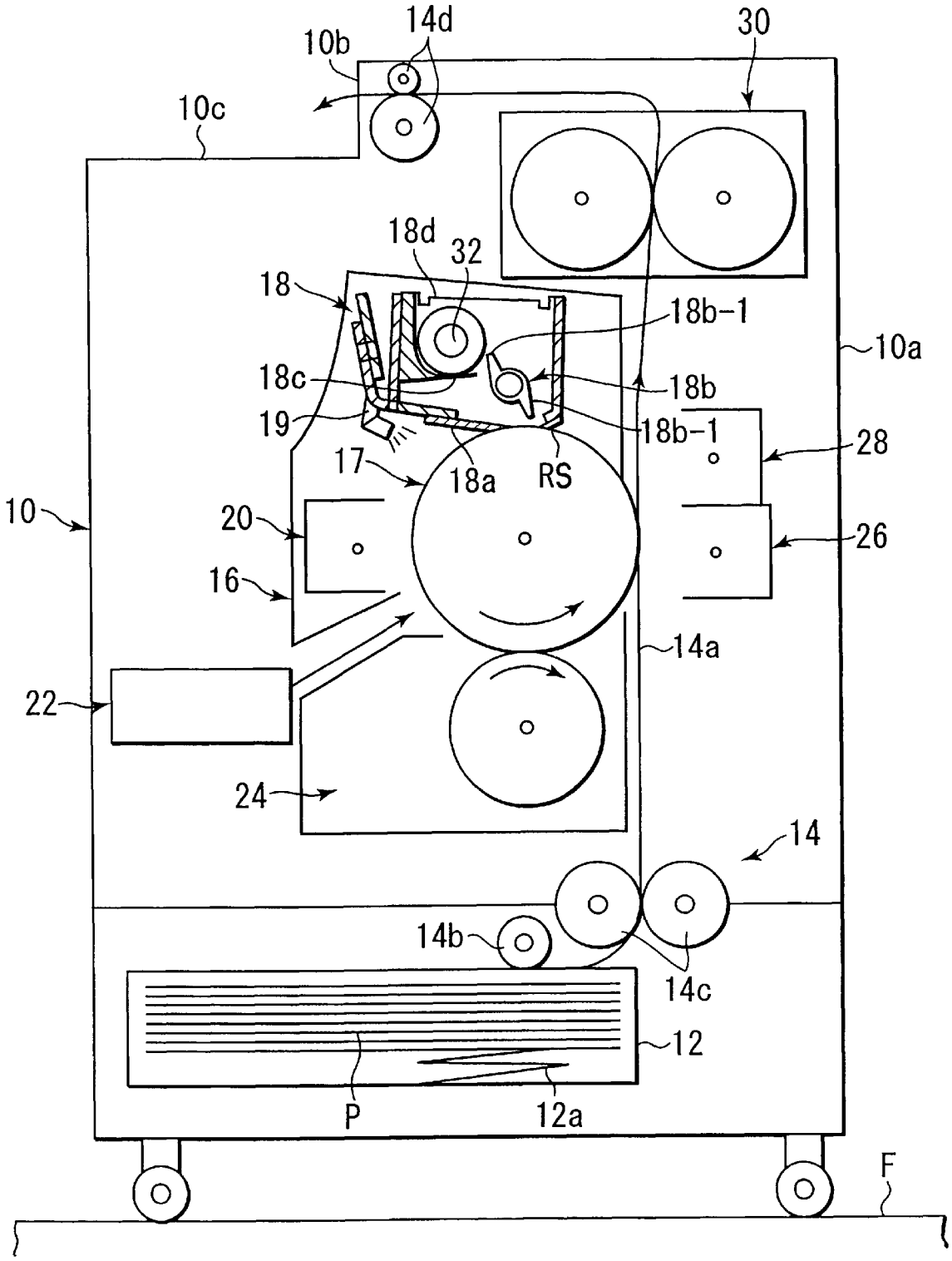
FIG. 1 is a vertical sectional view schematically showing a vertical section of an image forming apparatus comprising a process unit with a cleaner, according to an embodiment of the present invention.

FIG. 1 schematically shows a vertical sectional view of an image forming apparatus 10 comprising a process unit with a cleaner, according to an embodiment of the present invention. An outer housing 10*a* of the image forming apparatus 10 is placed on a floor F of a building. A paper feed cassette 12 is detachably arranged in the outer housing 10*a* at a predetermined position near the floor F. The paper feed cassette 12 contains a plurality of recording papers P in a stacked condition, the recording papers P having the same predetermined size and shape as to each other. In the paper feed cassette 12, an urging means 12*a* for upwardly urging one end portion of the plurality of stacked recording papers P is provided.

In the outer housing 10*a*, a recording paper conveyance path 14*a* extends upward from one end portion of the cassette 12, and an upper end of the recording paper conveyance path 14*a* reaches at an opening 10*b* formed in an upper wall of the outer housing 10*a*. A portion of an upper surface of the upper wall, located adjacent to the opening 10*b*, is configured as a discharged paper tray 10*c*. A pick-up roller 14*b* contacts the one end portion of an upper surface of an upper most recording paper in the plurality of stacked recording papers P urged upward in the cassette 12 as described above. At a lower end portion of the recording paper conveyance path 14*a*, a pair of recording paper feeding rollers 14*c* are arranged in both sides of the lower end portion. At an upper end portion of the recording paper conveyance path 14*a*, a pair of recording paper discharging rollers 14*d* are arranged in both sides of the upper end portion. Along an intermediate portion of the recording paper conveyance path 14*a* between the lower end portion and the upper end portion, a plurality of pairs of recording paper conveying rollers not shown are arranged in both sides of the intermediate portion.

When the pickup roller 14*b* makes one rotation, the uppermost recording paper in the plurality of stacked recording papers P in the cassette 12 is picked up by the pickup roller 14*b* toward the paired recording paper feeding rollers 14*c* at the lower end portion of the recording paper conveyance path 14*a*. The paired recording paper feeding rollers 14*c* feed the recording paper into the intermediate portion of the conveyance path 14*a*. The recording paper in the intermediate portion of the conveyance path 14*a* is conveyed by the plurality of pairs of recording paper conveying rollers not shown toward the paired recording paper discharging rollers 14*d* at the upper end portion of the conveyance path 14*a*. The paired recording paper discharging rollers 14*d* discharge the recording paper reached at the upper end portion of the conveyance path 14*a* onto the discharged paper tray 10*c* located adjacent to the opening 10*b* on the upper wall of the outer housing 10*a*, through the opening 10*b* of the upper wall.

As apparent from the above description, in this embodiment, the recording paper conveyance path 14*a*, the paired recording paper feeding rollers 14*c* at the lower end portion of the recording paper conveyance path 14*a*, the plurality of pairs of recording paper conveying rollers along the intermediate portion of the recording paper conveyance path 14*a*, and the paired recording paper discharging rollers 14*d* at the upper end portion of the recording paper conveyance path 14*a* configure a conveyor 14 for conveying the recording paper P upwardly in the outer housing 10*a*.

Further in the outer housing 10*a*, an image forming mechanism 16 is contained and the image forming mechanism 16 is used for forming a desired image by an electrophotographic process on the recording paper conveyed upward along the recording paper conveyance path 14*a* by the conveyor 14. The image forming mechanism 16 is arranged along the intermediate portion of the recording paper conveyance path 14*a*.

The image forming mechanism 16 in this embodiment comprises a photosensitive drum 17 which is arranged adjacent to the recording paper conveyance path 14*a* in one side of the recording paper conveyance path 14*a*. The photosensitive drum 17 is rotated in a predetermined direction by which a conveying direction of the recording paper in the conveyance path 14*a* at a position where the photosensitive drum 17 contacts the conveyed recording paper is made equal to a moving direction of the outer circumferential surface of the photosensitive drum 17 at the position where the photosensitive drum 17 contacts the conveyed recording paper.

The image forming mechanism 16 further includes a cleaner 18, a discharger 19, a charger 20, an exposing device 20, and a developing device 24 those of which are arranged around the outer circumferential surface of the photosensitive drum 17 from the upper portion of the outer circumferential surface to the lower portion thereof in the one side of the conveyance path 14*a*. The arrangement order of the cleaner 18, the discharger 19, the charger 20, the exposing device 20, and the developing device 24 around the outer circumferential surface of the photosensitive drum 17 is in accordance with the above described moving direction of the outer circumferential surface of the photosensitive drum 17.

The image forming mechanism 16 further includes a transfer device 26 and a separator 28 both of which are arranged in another side of the conveyance path 14*a*. The transfer device 26 is positioned near to the outer circumferential surface of the photosensitive drum 17, and the separator 28 is positioned in a down stream side of the transfer device 26 in the conveying direction of the recording paper in the conveyance path 14*a*.

In the outer housing 10*a*, a fixing device 30 is further arranged along the intermediate portion of the conveyance path 14*a* in the down stream side of the image forming mechanism 16 in the conveying direction of the recording paper in the conveyance path 14*a*.

In order to form a desired image on the recording paper in the image forming apparatus 10 according to the embodiment configured as described above, a recording paper is picked up from the cassette 12 to the conveyance path 14*a* by the pick-up roller 14*b*, and the photosensitive drum 17 is made one rotation in the predetermined direction at a predetermined speed. During this rotation, the charger 20 charges electrically and uniformly the outer circumferential surface of the photosensitive drum 17. The exposing device 22 forms a desired latent image corresponding to the desired image on the uniformly charged outer circumferential surface of the photosensitive drum 17. The developing device 24 develops the latent image on the outer circumferential surface of the photosensitive drum 17 with magnetic toner and forms a toner image. The transfer device 26 transfers the toner image on the outer circumferential surface of the photosensitive drum 17 onto the recording paper conveyed in the conveyance path 14*a* toward the photosensitive drum 17. The separator 28 separates the recording paper on which the toner image has been transferred, from the outer circumferential surface of the photosensitive drum 17. The fixing device 30 fixes the transferred toner image on the recording paper when the recording paper reaches at the fixing device 30 after the recording paper has been separated from the outer circumferential surface of the photosensitive drum 17. The recording paper on which the toner image corresponding to the desired image has been fixed is discharged onto the discharged recording paper tray 10*c* on the upper wall of the outer housing 10*a* by the paired recording paper discharging rollers 14*d* at the upper end portion of the conveyance path 14*a*.

Residual toner on the outer circumferential surface of the photosensitive drum 17 after the toner image has been transferred from the outer circumferential surface to the recording paper by the transfer device 26, is removed from the outer circumferential surface of the photosensitive drum 17 by the cleaner 18. Next, the discharger 19 discharges residual electric charge from the outer circumferential surface of the photosensitive drum 17, and the outer circumferential surface of the photosensitive drum 17 is ready for a next image formation.

In the vertical conveyance type image forming apparatus 10 configured as described above, the cleaner 18 is located near to the upper portion of the outer circumferential surface of the photosensitive drum 17.

In the following, a configuration of the cleaner 18 will be described in detail with reference to FIG. 2, in addition to FIG. 1.

The cleaner 18 includes a blade 18*a* which has a tip end contacting the upper portion of the outer circumferential surface of the photosensitive drum 17, a paddle 18*b* which is located near and above the tip end of the blade 18*a*, a scraper 18*c* which is provided in a position near the paddle 18*b* but opposite to the outer circumferential surface of the photosensitive drum 17 and a container (or housing) 18*d* which contains the blade 18*a*, the paddle 18*b*, and the scraper 18*c*.

The container (or housing) 18*d* has an opening which faces the upper portion of the outer circumferential surface of the photosensitive drum 17.

The tip end of the blade 18*a* is located in the opening of the container 18*d* and directs in a direction opposite to the above described predetermined rotating direction of the photosensitive drum 17. The blade 18*a* has a base end portion which is fixed to the container 18*d*. During the photosensitive drum 17 rotates in the above described predetermined direction, the free end of blade 18*a* scrapes the magnetic toner (residual toner) T sticking on the outer circumferential surface of the photosensitive drum 17 after the toner image transfer has been performed by the transfer device 26. The scraped residual toner T stays on the upper portion of the outer circumferential surface of the photosensitive drum 17 by gravity, even though the photosensitive drum 17 rotates.

A base end portion of a recovery sheet RS is fixed to a front edge of the opening of the container 18*d*, the front edge being located in a direction opposite to the above described predetermined rotating direction of the photosensitive drum 17. The recovery sheet RS extends from the front edge in the above described predetermined rotating direction of the photosensitive drum 17 and the extending end of the recovery sheet RS contacts the upper portion of the outer circumferential surface of the photosensitive drum 17. The recovery sheet RS prevents the scraped residual toner T stayed on the upper portion of the outer circumferential surface of the photosensitive drum 17 even though the photosensitive drum 17 rotates, from falling out from the upper portion of the outer circumferential surface of the photosensitive drum 17 in a front edge side of the opening of the container 18*d*.

The paddle 18*b* has a rotation center C and at least one arm 18*b*-1 projecting outward from the rotation center C in a radial direction of the rotation center C. The paddle 18*b* is rotated at a predetermined speed in a predetermined direction by a rotation force applied to the paddle 18*b* from a rotation power source not shown during the photosensitive drum 17 rotates, and the rotation direction of the paddle 18*b* is the same as that of the photosensitive drum 17. In this embodiment, the paddle 18*b* has two arms 18*b*-1, but the paddle 18*b* may have only one arm or any number of arms.

The paddle 18*b* is located near a toner scraping position on the upper portion of the outer circumferential surface of the photosensitive drum 17, at the toner scraping position the free end of the blade 18*a* contacting the upper portion of the outer circumferential surface of the photosensitive drum 17. The paddle 18*b* rotates in the predetermined direction, and moves or feeds cyclically the scraped residual toner T stayed on the upper portion of the outer circumferential surface of the photosensitive drum 17, upward away from the upper portion by the two arms 18*b*-1.

In this embodiment, at least two arms 18*b*-1 of the paddle 18*b* are made of a magnet. One magnetic pole of the magnet which attracts the magnetic toner T is orientated in the rotation direction of the paddle 18*b*, and another magnetic pole of the magnet 18*b*-2 which distracts the magnetic toner T is orientated in the direction opposite to the rotation direction of the paddle 18*b*.

During the rotation of the paddle 18*b*, the two arms 18*b*-1 of the paddle 18 cyclically approach the scraped residual toner T stayed on the upper portion of the outer circumferential surface of the photosensitive drum 17, and attract the scraped residual toner T on paddle rotation direction sides FS and radial direction outer ends OE by magnetic force. The scraped residual toner T attracted on the paddle rotation direction sides FS and the radial direction outer ends OE of the two arms 18*b*-1 of the paddle 18*b*, respectively, do not fall from the paddle rotation direction sides FS and the radial direction outer ends OE of the two arms 18*b*-1 while each of the two arms 18*b*-1 moves upward from the toner scraping position on the upper portion of the outer circumferential surface of the photosensitive drum 17. Since at least the two arms 18*b*-1 of the paddle 18*b* are formed of a magnet, each of the two arms 18*b*-1 can attract the scraped residual toner T stayed on the upper portion of the outer circumferential surface of the photosensitive drum 17 at every time when each arm 18*b*-1 approaches the scraped residual toner T and no scraped residual toner T is stayed on the upper portion of the outer circumferential surface.

The scraper 18*c* is provided in the container 18*d* in a side of the paddle 18*b* which is opposite to the outer circumferential surface of the photosensitive drum 17, and has a free end PE and a base portion fixed on the container 18*d*. The free end PE of the scraper 18*c* is positioned outside of and near to a rotation locus drawn by the radial direction outer ends OE of the two arms 18*b*-1 of the paddle 18*b* while the paddle 18*b* rotates. The free end PE is located above at least an intermediate portion between the free end PE and the base portion, so that the scraper 18*c* configures a scraped residual toner receiver.

It is assumed that the shortest distance between the free end PE of the scraper 18*c* and the above-described rotation locus is represented as A, and suppose that the shortest distance between the free end PE of the scraper 18*c* and the outer circumferential surface of the photosensitive drum 17 is represented as B, these values of A and B is set so as to be $0.1 \leqq B/A \leqq 0.3$.

It should be noted that the respective values of the A and B are set so as to achieve the following items: firstly, a contact of the free end PE of the scraper 18*c* with the radial direction outer ends OE of the two arms 18*b*-1 of the paddle 18*b* during the rotation of the paddle 18*b*, and a contact of each of the radial direction outer ends OE of the two arms 18*b*-1 of the paddle 18*b* with the upper portion of the outer circumferential surface of the photosensitive drum 17, are prevented. Secondary, at the same time, a prevention of a largely reducing moving efficiency of the scraped residual toner T from the upper portion of the outer circumferential surface of the photosensitive drum 17 by the paddle rotation direction side FS and the radial direction outer end OE of each of the two arms 18*b*-1, and a sufficient separation of the attracted scraped residual toner T from the paddle rotation direction side FS and the radial direction outer end OE of each of the two arms 18*b*-1 by the free end PE of the scraper 18*c*, are assured. And, finally, an occurrence of image forming fault of the photosensitive drum 17 due to an increase of an amount of the scraped residual toner T on the upper portion of the outer circumferential surface of the photosensitive drum 17 is prevented.

During the paddle 18*b* rotates as described above, one portion of the scraped residual toner T attracted on the paddle rotation direction side FS and the radial direction outer end OE of each of the two arms 18*b*-1 contacts with the free end PE of the scraper 18*c* as each of the two arms 18*b*-1 approaches the free end PE positioned in the side of the paddle 18*b* opposite to the outer circumferential surface of the photosensitive drum 17. As the paddle 18*b* rotates more further, each of the two arms 18*b*-1 further moves with contact of one portion of the attracted scraped residual toner T contacting with the free end PE of the scraper 18*c*, so that the above described one portion of the attracted scraped residual toner T, together with portions of the attracted scraped residual toner T excepting for the above described one portion thereof, is drawn out and separated from the paddle rotation direction side FS and the radial direction outer end OE of each of the two arms 18*b*-1 because all of the magnetically attracted scraped residual toner T are magnetically connected with each other.

According to an experiment carried out by inventors of the present invention, by setting the values of the above described sizes A and B in the above relationship, the amount of the scraped residual toner T staying on the upper portion of the outer circumferential surface of the photosensitive drum 17 can be suppressed over a long time period to an extent that an image forming quality by the photosensitive drum 17 is not deteriorated. Moreover, since the free end PE of the scraper 18*c* does not contact with the arms 18*b*-1 of the paddle 18, abrasions and noise generated by sliding contact of the free end PE of the scraper 18*c* with the arms 18*b*-1 of the paddle 18 can be prevented.

In the above-described embodiment, the toner T is a magnetic toner and at least two arms 18*b*-1 of the paddle 18*b* are made of a magnet. But, even if the toner has no magnetic property and the two arms 18*b*-1 are not made of a magnet or do not have a magnet, the amount of the scraped residual toner attached to the at least two arms 18*b*-1 of the paddle 18*b* can be suppressed less than a certain amount for a long time use only by setting the values of the above sizes A and B to the above described special relationship. Further, the above described special relationship can prevent the amount of moving of the scraped residual toner from the upper portion of the outer circumferential surface of the photosensitive drum 17 performed by the at least two arms 18*b*-1 of the paddle 18*b* from lowering (that is, can prevent toner moving efficiency by the at least two arms 18*b*-1 of the paddle 18*b* from lowering) under a certain level, and a deterioration of an image forming quality caused by the photosensitive drum 17 can be prevented over a long time period. Further, since there is no contact of the at least two arms 18*b*-1 of the paddle 18*b* with the free end PE of the scraper 18*c*, the abrasions and noise generated by the contact can be prevented.

According to the above-described embodiment, the paddle rotation direction side FS of each of the two arms 18*b*-1 of the paddle 18*b* is gradually inclined in a direction opposite to the paddle rotation direction as being away from a base end of each of the arms 18*b*-1 to an extending end in a radial direction of the paddle 18*b*. Owing to this inclination, the scraped residual toner attracted on the paddle rotation direction side FS of each of the two arms 18*b*-1 of the paddle 18*b* can be scraped easily by the free end PE of the scraper 18*c* as the rotation of the paddle 18*b*.

The scraped residual toner T scraped from the paddle rotation direction side FS and the radial direction outer end OE of each of the two arms 18*b*-1 by the free end PE of the scraper 18*c* is received by the scraped residual toner receiver of the intermediate portion of the scraper 18*c*.

An auger conveyor 32 is arranged above and near the upper surface of the intermediate portion of the scraper 18*c* in the container 18*d*. The auger conveyor 32 discharges the scraped residual toner T received by the upper surface of the intermediate portion of the scraper 18*c*, to a residual toner reservoir located outside of the container 18*d* and not shown.

The scraped residual toner receiver may be formed independently of the scraper 18*c*.

According to the cleaner 18 of the image forming apparatus 10 configured as described above, the scraped residual toner T which is scraped from the upper portion of the outer circumferential surface of the photosensitive drum 17 and stayed on the upper portion of the outer circumferential surface, is attracted on the paddle rotation direction side FS and the radial direction outer end OE of each of the two arms 18*b*-1 of the paddle 18*b* while the paddle 18*b* rotates. The scraped residual toner T which is moved away upwardly from the upper portion of the outer circumferential surface with the two arms 18*b*-1 by the rotation of the paddle 18*b*, is in contact with the free end PE of the scraper 18*c* positioned near to the rotation locus of the radial direction outer ends OE of the two arms 18*b*-1 of the paddle 18*b* and is scraped from the paddle rotation direction side FS and the radial direction outer end OE of each of the two arms 18*b*-1 of the paddle 18*b*. The scraped residual toner T scraped by the scraper 18*c* is received by the scraped residual toner receiver (intermediate portion of the scraper 18*c*), and is finally discharged from the scraped residual toner receiver to the residual toner reservoir located outside of the container 18*d* and not shown.

Therefore, the scraped residual toner T can be moved more surely and more efficiently from the upper portion of the outer circumferential surface of the photosensitive drum 17 to a position located away from the upper portion of the outer circumferential surface, and an amount of the scraped residual toner T stayed on the upper portion of the outer circumferential surface can be reduced greatly. Further, since there is no contact of the free end PE of the scraper 18*c* with the at least two arms 18*b*-1 of the paddle 18*b*, the abrasions and noise generated by the sliding contact of the free end PE of the scraper 18*c* with the at least two arms 18*b*-1 of the paddle 18*b* are prevented. Moreover, damage of the at least two arms 18*b*-1 of the paddle 18*b* made of a comparatively expensive and comparatively fragile magnet can be prevented.

Next, a configuration of a process unit with a cleaner according to another embodiment of the present invention will be described below with reference to FIG. 3.

Figure 2:
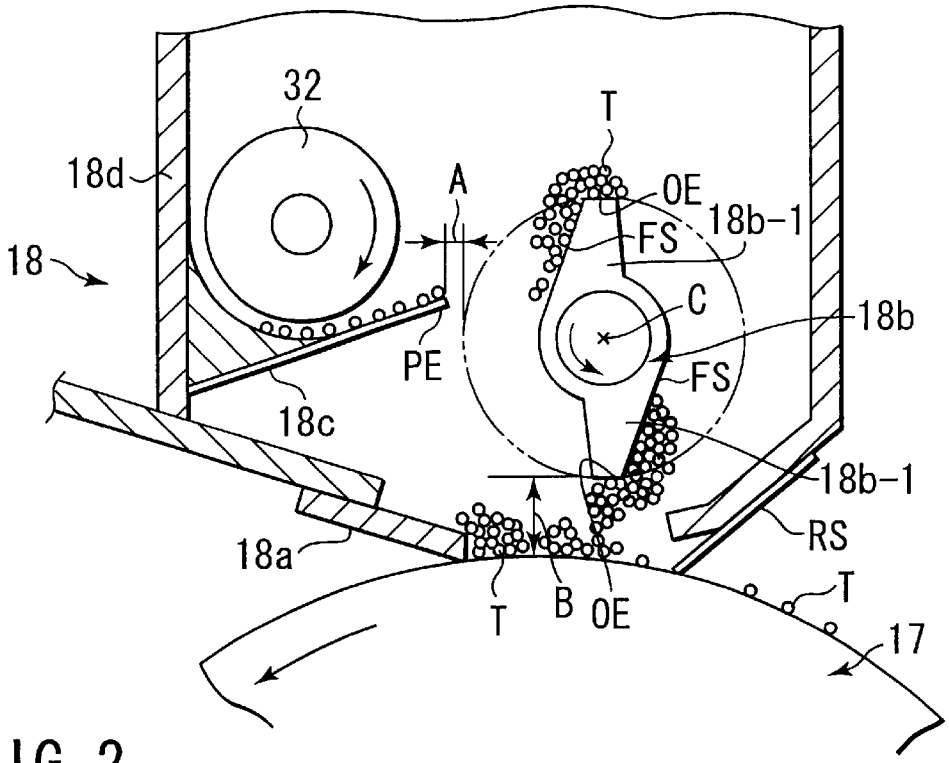
FIG. 2 is a vertical sectional view showing an enlarged vertical section of a main portion of the cleaner of FIG. 1.

It should be noted that most portions of the configurations of the process unit with a cleaner according to another embodiment is the same as most portions of the configuration of the process unit with a cleaner according to the above-described one embodiment with reference to FIG. 1 and FIG. 2.

Figure 3:
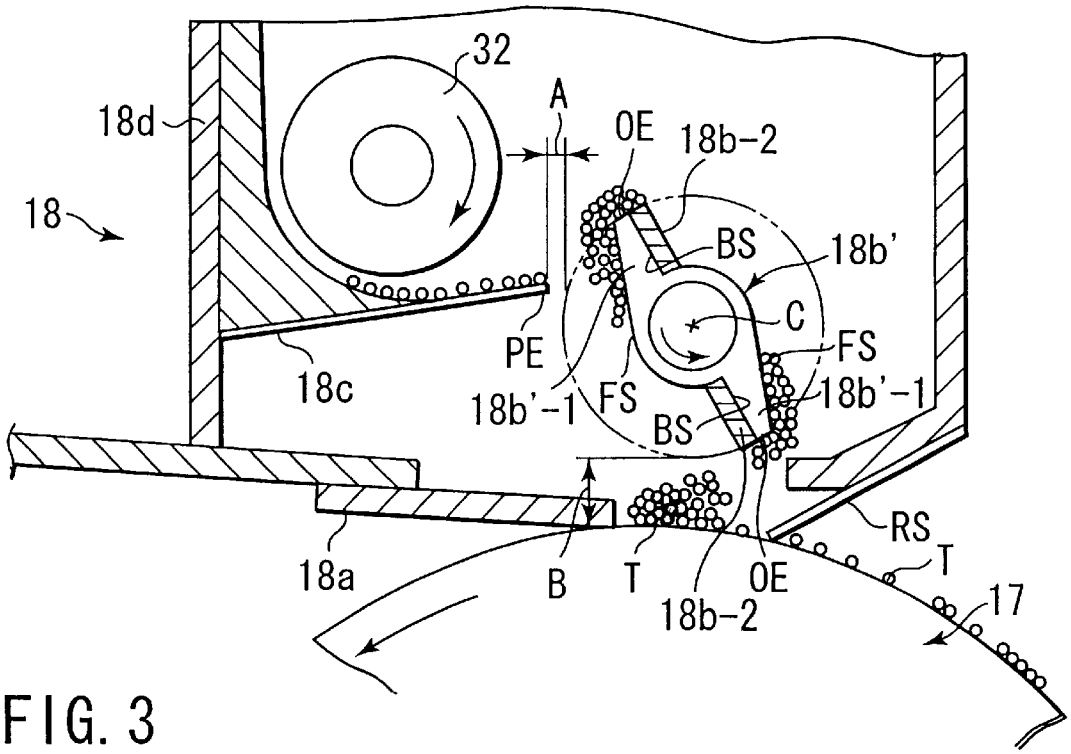
FIG. 3 is a vertical sectional view showing an enlarged vertical section of a main portion of a process unit with a cleaner, according to another embodiment of the present invention.

Therefore, in an embodiment shown in FIG. 3, an element which corresponds to the element shown in FIGS. 1 and 2 is designated by the reference character which is the same as that designating the element shown in FIGS. 1 and 2 and corresponding to the element of the embodiment shown in FIG. 3, and a detailed description about the element corresponding to the element shown in FIGS. 1 and 2 will be omitted.

The difference found in the embodiment shown in FIG. 3 from the embodiment of FIGS. 1 and 2 is a configuration of the paddle 18*b*'. In the paddle 18*b*', at least two arms 18*b*'-1 are made of a synthetic resin, and a magnet 18*b*-2 is fixed on a rotation direction opposite side BS of each of the two arms 18*b*'-1, the rotation direction opposite side BS being located on each of the two arms 18*b*'-1 in a direction opposite to the rotation direction of the paddle 18*b*'. One magnetic pole of the magnet 18*b*-2 which attracts the magnetic toner T is orientated in the rotation direction of the paddle 18*b*', and another magnetic pole of the magnet 18*b*-2 which distracts the magnetic toner T is orientated in the direction opposite to the rotation direction of the paddle 18*b*'.

The paddle 18*b*' configured as described above can be manufactured in a cheap cost, in a light weight, and in less damage to a force applied thereto, comparing to the paddle 18*b* of the embodiment shown in FIGS. 1 and 2 in which the at least two arms 18*b*-1 are made of a magnet. Further, it can function similarly to the paddle 18*b* of the embodiment of FIGS. 1 and 2.

Further, the at least two arms 18*b*'-1 of the paddle 18*b*' shown in FIG. 3 can be made of a material having electrical conductivity, for example, a copper alloy, an aluminum alloy, an electrical conductive resin and the like, and the magnet 18*b*-2 can be fixed on the rotation direction opposite side BS of each of the two arms 18*b*'-1. Also, in this case, one magnetic pole of the magnet 18*b*-2 which attracts the magnetic toner T is orientated in the rotation direction of the paddle 18*b*', and another magnetic pole of the magnet 18*b*-2 which distracts the magnetic toner T is orientated in the direction opposite to the rotation direction of the paddle 18*b*'.

Even in this case, the paddle 18*b*' made as described above can be manufactured in a cheap cost, in a light weight, and in less damage to a force applied thereto, comparing to the paddle 18*b* of the embodiment shown in FIGS. 1 and 2 in which the at least two arms 18*b*-1 are made of a magnet. Further, it can function similarly to the paddle 18*b* of the embodiment of FIGS. 1 and 2. When comparing to the former case where the at least two arms 18*b*-1 are made of a synthetic resin, the latter case where the at least two arms 18*b*-1 are made of a material having electrical conductivity can increase a magnetic attraction force by which the scraped residual toner T stayed on the upper portion of the outer circumferential surface of the photosensitive drum 17 is attracted on the at least two arms 18*b*-1, and a moving efficiency of the scraped residual toner T from the upper portion of the outer circumferential surface is increased.

Next, a paddle which is used in a process unit with a cleaner according to still another embodiment of the present invention will be described in detail with reference to FIG. 4 and FIG. 5.

It should be noted that most portions of the configurations of the process unit with a cleaner according to still another embodiment is the same as most portions of the configuration of the process unit with a cleaner according to the above-described one embodiment with reference to FIG. 1 and FIG. 2.

Figure 4:
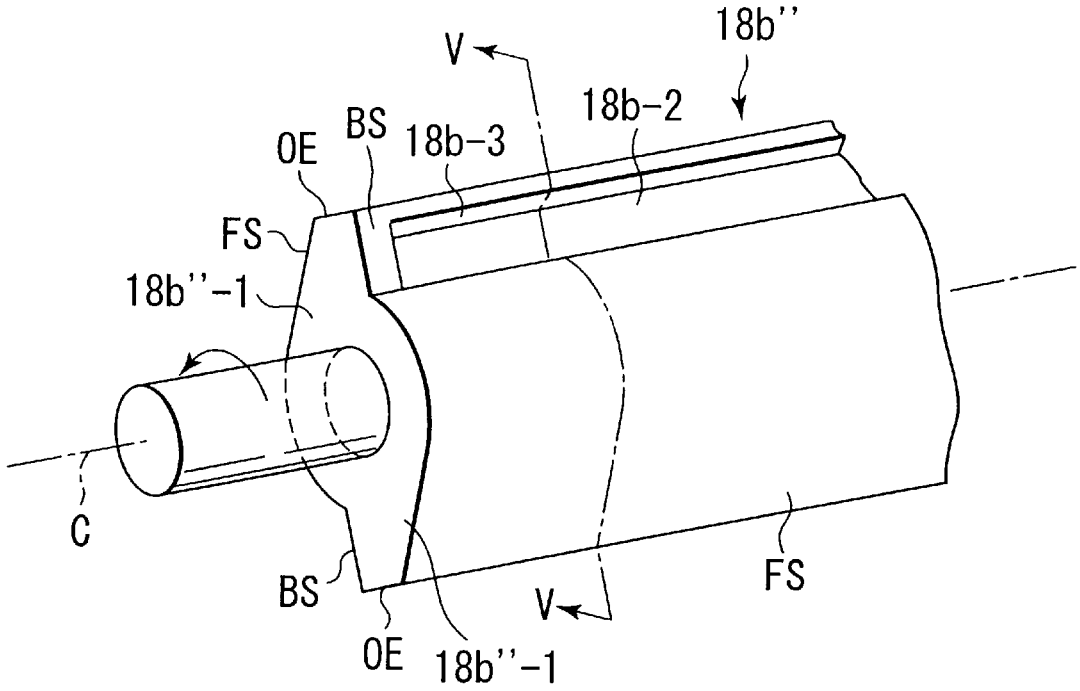
FIG. 4 is a perspective view showing an enlarged main portion of a paddle used in a process unit with a cleaner, according to still another embodiment of the present invention.
Figure 5:
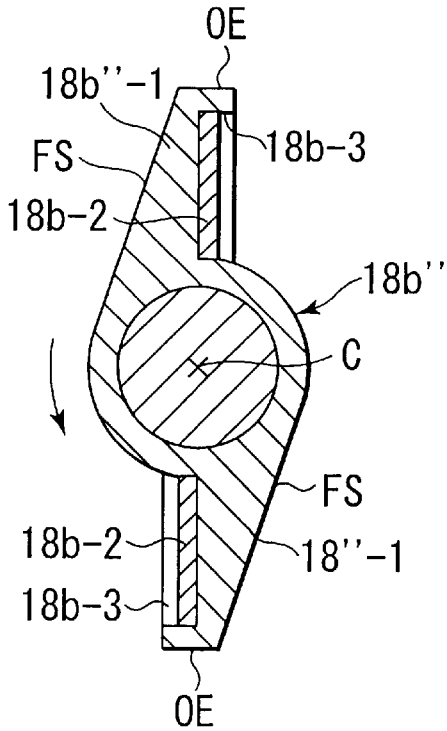
FIG. 5 is a vertical transverse sectional view taken along a V—V line of the paddle of FIG. 4.

The difference found in the embodiment shown in FIGS. 4 and 5 from the embodiment of FIGS. 1 and 2 is a configuration of the paddle 18*b*″.

Therefore, in an embodiment shown in FIGS. 4 and 5, an element which corresponds to the element shown in FIGS. 1 and 2 is designated by the reference character which is the same as that designating the element shown in FIGS. 1 and 2 and corresponding to the element of the embodiment shown in FIGS. 4 and 5, and a detailed description about the element corresponding to the element shown in FIGS. 1 and 2 will be omitted.

In the paddle 18*b*" shown in FIGS. 4 and 5, at least two arms 18*b*"-1 are made of a material having electrical conductivity, such as a copper alloy, an aluminum alloy, an electrically conductive resin and the like, and a magnet storage concave portion 18*b*-3 is formed in the rotation direction opposite side BS of each of the two arms 18*b*"-1 of the paddle 18*b*", the magnet storage concave portion 18*b*-3 being extending along a rotation center line C of the paddle 18*b*″.

Magnet 18*b*-2 in a strip shape is stored and fixed in the magnet storage concave portion 18*b*-3. One magnetic pole of the magnet 18*b*-2 which attracts the magnetic toner T is orientated in the rotation direction of the paddle 18*b*", and another magnetic pole of the magnet 18*b*-2 which distracts the magnetic toner T is orientated in the direction opposite to the rotation direction of the paddle 18*b*″.

Radially outer end of the magnet 18*b*-2 in the magnet storage concave portion 18*b*-3 is covered by the radial direction outer end OE of the arm 18*b*"-1. Further, the radial direction outer end OE of the arm 18*b*"-1 extends beyond the radial direction outer end of the magnet 18*b*-2 corresponding to the radial direction outer end OE, in the magnet storage concave portion 18*b*-3 in the direction opposite to the moving direction of the arm 18*b*" when the paddle 18*b*" is rotated. This means that a surface area of the radial direction outer end OE of the arm 18*b*"-1 is larger than a surface area of the radial direction outer end of the magnet 18*b*-2, so that the magnetic force acting on the radial direction outer end of the magnet 18*b*-2 can act even on the radial direction outer end OE of the corresponding arm 18*b*"-1 having larger area than the radial direction outer end of the magnet 18*b*-2.

Both side ends of the magnet 18*b*-2 located in a direction along the rotation center line C of the paddle 18*b*" in the magnet storage concave portion 18*b*-3, are also covered by both side ends of the arm 18*b*"-1 located in the direction along the rotation center line C.

The paddle 18*b*" configured as described above and shown in FIGS. 4 and 5 can obtain technological advantages obtained similarly by the paddle 18*b*' shown in FIG. 3. Further, although a size of the magnet 18*b*-2 in the rotation direction of the paddle 18*b*" is made smaller than that of the paddle 18*b* of FIG. 3 in which the radial direction outer end of the magnet 18*b*-2 is exposed to an outer space, an amount of the scraped and residual magnetic toner T attracted on the radial direction outer end OE of the arm 18*b*"-1 by the magnetic force acting radially outwardly from the magnet 18*b*-2 is not reduced but be increased, because the size of the radial direction outer end OE of the arm 18*b*"-1 in the rotation direction of the paddle 18*b*" is larger than that of the magnet 18*b*-2.

Figure 6:
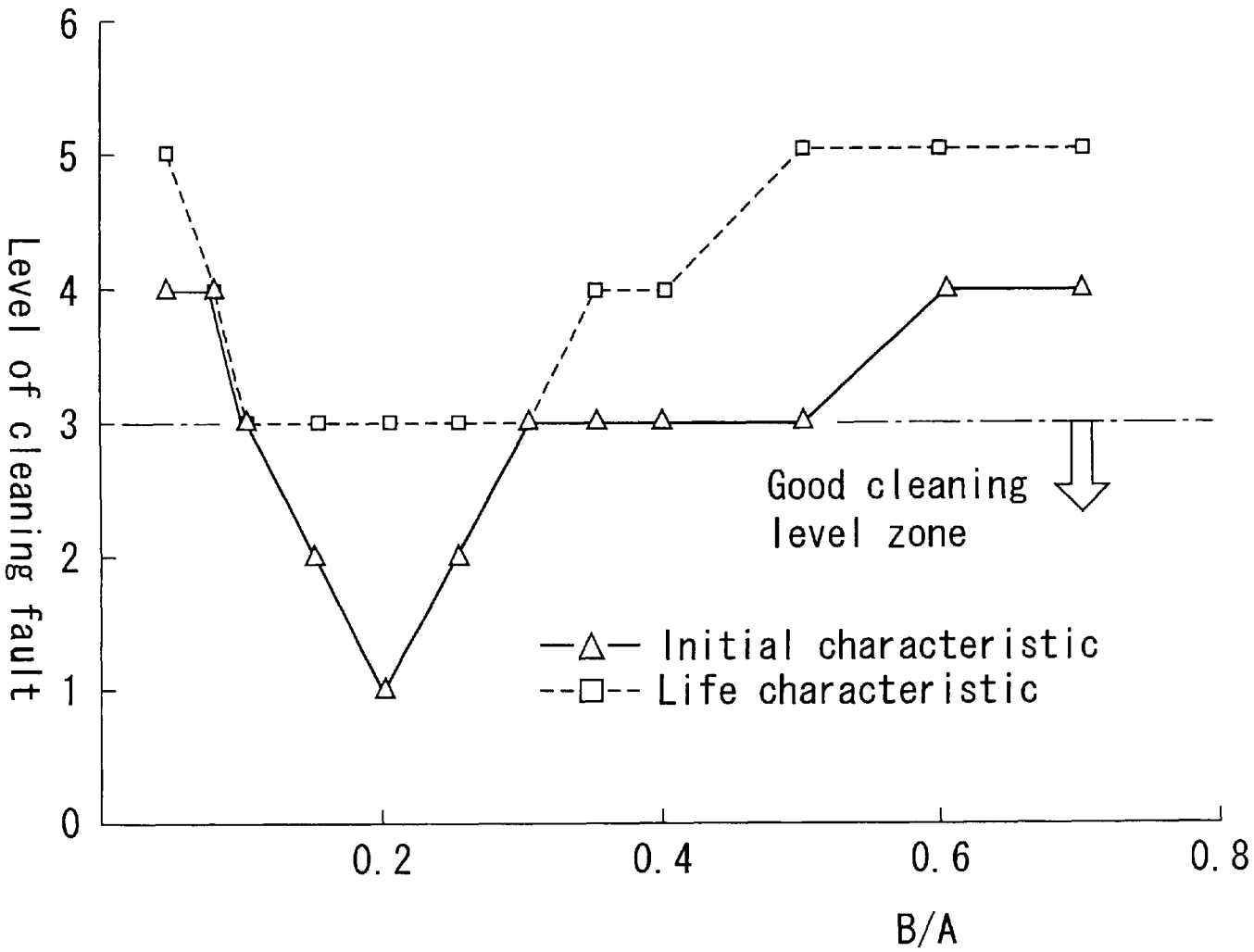
FIG. 6 is a graph showing a relationship between a predetermined size ratio of B/A of the cleaner and a level of cleaning fault in an image forming apparatus comprising a process unit with a cleaner shown in each of FIG. 2 or FIG. 3.

FIG. 6 shows levels of cleaning faults as Initial characteristics obtained by image formations in the image forming device 10 which comprises a novel process unit with the cleaner 18 shown in FIG. 2 or 3 when the image formation is carried out on recording papers P each of which has a predetermined size (A4 size of Japanese Industrial Standard: 210 mm×297 mm) with changing the "B/A" value.

FIG. 6 also shows levels of cleaning faults as Life characteristics obtained by image formations in the image forming device 10 which comprises the process unit with the cleaner 18 shown in FIG. 2 or 3 after the image formations has been carried out continuously on 2500 sheets of recording papers P each of which has a predetermined size (A4 size of Japanese Industrial Standard: 210 mm×297 mm) with changing the "B/A" value.

According to the cleaning fault level uniquely set by the inventors of the present invention, if it is the level 3 or less, it is recognized generally that there is no fault in a quality of the formed image. If it is the level 3 or more, the removal efficiency of the scraped and residual toner T by the paddle 18*b* or the paddle 18*b*' in the cleaner 18 from the upper portion of the outer circumferential surface of the photosensitive drum 17, is poor, so that the amount of the scraped and residual toner T staying on the upper portion of the outer circumferential surface of the photosensitive drum 17 increases as the number of times for which image formations are performed increases, therefore, the scraped and residual toner T cannot be completely removed from the outer circumferential surface of the photosensitive drum 17 in the cleaner 18, and a memory image phenomenon is formed on the outer circumferential surface of the photosensitive drum 17.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A process unit comprising:

a photosensitive drum which is rotatable and has an outer circumferential surface on which toner is to be sticked; and a cleaner which removes toner sticking on the outer circumferential surface of the photosensitive drum;

wherein the cleaner includes:

a blade which scrapes the toner sticking on the outer circumferential surface of the photosensitive drum from the outer circumferential surface, a paddle having a rotation center and at least one arm projecting outward from the rotation center in a radial direction of the rotation center, said paddle being rotatable in a predetermined direction at a position near a toner scraping position of the blade on the outer circumferential surface of the photosensitive drum, and said paddle cyclically moving the scraped toner scraped by the blade from the toner scraping position, and a scraper which is provided in a side of the paddle opposite to the outer circumferential surface of the photosensitive drum, said scraper having a free end disposed radially outwardly and near to a rotation locus drawn by a radially directional outer end of the arm of the paddle during a rotation of the paddle, and said free end scraping the scraped toner carried by the arm of the paddle rotated to an opposite side during rotation of the paddle, and wherein the toner is magnetic and the arm of the paddle is made of a magnet.

2. The process unit according to claim 1, wherein a shortest distance between the free end of the scraper and a rotation locus drawn by the radially directional outer end of the arm of the paddle during rotation of the paddle is represented as A, and a shortest distance between the rotation locus and the outer circumferential surface of the photosensitive drum is represented as B, and wherein $0.1<B/A<0.3$.

3. The process unit according to claim 1, further comprising a scraped toner receiver which receives the scraped toner scraped by the scraper from the arm of the paddle.

4. The process unit according to claim 1, wherein the scraper comprises a scraped toner receiver which receives the scraped toner scraped by the scraper from the arm of the paddle.

5. The process unit according to claim 4, wherein:

the cleaner further includes a container containing the blade, the paddle, the scraper and the scraped toner receiver, and the scraper has a base portion fixed on the container and an intermediate portion between the base portion and the free end, and the free end of the scraper is positioned above at least the intermediate portion in the container.

6. A process unit comprising:

a photosensitive drum which is rotatable and has an outer circumferential surface on which toner is to be sticked; and a cleaner which removes toner sticking on the outer circumferential surface of the photosensitive drum;

wherein the cleaner includes:

a blade which scrapes the toner sticking on the outer circumferential surface of the photosensitive drum from the outer circumferential surface, a paddle having a rotation center and at least one arm projecting outward from the rotation center in a radial direction of the rotation center, said paddle being rotatable in a predetermined direction at a position near a toner scraping position of the blade on the outer circumferential surface of the photosensitive drum, and said paddle cyclically moving the scraped toner scraped by the blade from the toner scraping position, and a scraper which is provided in a side of the paddle opposite to the outer circumferential surface of the photosensitive drum, said scraper having a free end disposed radially outwardly and near to a rotation locus drawn by a radially directional outer end of the arm of the paddle during a rotation of the paddle, and said free end scraping the scraped toner carried by the arm of the paddle rotated to an opposite side during rotation of the paddle, and wherein the toner is magnetic and the arm of the paddle comprises a magnet.

7. The process unit according to claim 6, wherein the arm of the paddle is made of electrically conductive material, the magnet is provided on a side of the arm located in a direction opposite to the rotation direction of the paddle, and the magnetic toner is mainly attracted to a rotation direction side of the arm by the magnet.

8. The process unit according to claim 7, wherein the arm of the paddle covers an end portion of the magnet located outward in a radial direction of the paddle.

9. The process unit according to claim 6, wherein a shortest distance between the free end of the scraper and a rotation locus drawn by the radially directional outer end of the arm of the paddle during rotation of the paddle is represented as A, and a shortest distance between the rotation locus and the outer circumferential surface of the photosensitive drum is represented as B, and wherein $0.1<B/A<0.3$.

10. The process unit according to claim 6, further comprising a scraped toner receiver which receives the scraped toner scraped by the scraper from the arm of the paddle.

11. The process unit according to claim 6, wherein the scraper comprises a scraped toner receiver which receives the scraped toner scraped by the scraper from the arm of the paddle.

12. The process unit according to claim 11, wherein:

the cleaner further includes a container containing the blade, the paddle, the scraper and the scraped toner receiver, and the scraper has a base portion fixed on the container and an intermediate portion between the base portion and the free end, and the free end of the scraper is positioned above at least the intermediate portion in the container.

13. An image forming apparatus comprising:

a conveyor which conveys a recording paper;

a photosensitive drum which rotates in a predetermined direction;

a charger which charges an outer circumferential surface of the photosensitive drum;

an exposure device which forms a desired electrostatic latent image on the charged outer circumferential surface of the photosensitive drum;

a developing device which develops the electrostatic latent image by toner and forms a toner image;

a transfer device which transfers the toner image formed on the outer circumferential surface of the photosensitive drum to the recording paper conveyed by the conveyor; and a cleaner which removes toner sticking on the outer circumferential surface of the photosensitive drum after the toner image is transferred from the outer circumferential surface of the photosensitive drum to the recording paper conveyed by the conveyor, wherein the cleaner is provided adjacent to the outer circumferential surface of the photosensitive drum, and the cleaner includes:

a blade which scrapes the toner sticking on the outer circumferential surface of the photosensitive drum from the outer circumferential surface, a paddle having a rotation center and at least one arm projecting outward from the rotation center in a radial direction of the rotation center, said paddle being rotatable in a predetermined direction at a position near a toner scraping position of the blade on the outer circumferential surface of the photosensitive drum, and said paddle cyclically moving the scraped toner scraped by the blade from the toner scraping position, and a scraper which is provided in a side of the paddle opposite to the outer circumferential surface of the photosensitive drum, said scraper having a free end disposed radially outwardly and near to a rotation locus drawn by a radially directional outer end of the arm of the paddle during a rotation of the paddle, and said free end scraping the scraped toner carried by the arm of the paddle rotated to an opposite side during rotation of the paddle, and wherein the toner is magnetic and the arm of the paddle is made of a magnet.

14. The image forming apparatus according to claim 13, wherein a shortest distance between the free end of the scraper and a rotation locus drawn by the radially directional outer end of the arm of the paddle during rotation of the paddle is represented as A, and a shortest distance between the rotation locus and the outer circumferential surface of the photosensitive drum is represented as B, and wherein $0.1<B/A<0.3$.

15. The image forming apparatus according to claim 13, further comprising a scraped toner receiver which receives the scraped toner scraped by the scraper from the arm of the paddle.

16. The image forming apparatus according to claim 13, wherein the scraper comprises a scraped toner receiver which receives the scraped toner scraped by the scraper from the arm of the paddle.

17. The image forming apparatus according to claim 16, wherein:

the cleaner further includes a container containing the blade, the paddle, the scrapper and the scraped toner receiver, and the scraper has a base portion fixed on the container and an intermediate portion between the base portion and the free end, and the free end of the scraper is positioned above at least the intermediate portion in the container.

18. An image forming apparatus comprising:

a conveyor which conveys a recording paper;

a photosensitive drum which rotates in a predetermined direction;

a charger which charges an outer circumferential surface of the photosensitive drum;

an exposure device which forms a desired electrostatic latent image on the charged outer circumferential surface of the photosensitive drum;

a developing device which develops the electrostatic latent image by toner and forms a toner image;

a transfer device which transfers the toner image formed on the outer circumferential surface of the photosensitive drum to the recording paper conveyed by the conveyor; and a cleaner which removes toner sticking on the outer circumferential surface of the photosensitive drum after the toner image is transferred from the outer circumferential surface of the photosensitive drum to the recording paper conveyed by the conveyor, wherein the cleaner is provided adjacent to the outer circumferential surface of the photosensitive drum, and the cleaner includes:

a blade which scrapes the toner sticking on the outer circumferential surface of the photosensitive drum from the outer circumferential surface, a paddle having a rotation center and at least one arm projecting outward from the rotation center in a redial direction of the rotation center, said paddle being rotatable in a predetermined direction at a position near a toner scraping position of the blade on the outer circumferential surface of the photosensitive drum, and said paddle cyclically moving the scraped toner scraped by the blade from the toner scraping position, and a scraper which is provided in a side of the paddle opposite to the outer circumferential surface of the photosensitive drum, said scraper having a free end disposed radially outwardly and near to a rotation locus drawn by a radially directional outer end of the arm of the paddle during a rotation of the paddle, and said free end scraping the scraped toner carried by the arm of the paddle rotated to an opposite side during rotation of the paddle, and wherein the toner is magnetic and the arm of the paddle comprises a magnet.

19. The image forming apparatus according to claim 18, wherein the arm of the paddle is made of electrically conductive material, the magnet is provided on a side of the arm located in a direction opposite to the rotation direction of the paddle, and the magnetic toner is mainly attracted to a rotation direction side of the arm by the magnet.

20. The image forming apparatus according to claim 19, wherein the arm of the paddle covers an end portion of the magnet located outward in a radial direction of the paddle.

21. The image forming apparatus according to claim 18, wherein a shortest distance between the free end of the scraper and a rotation locus drawn by the radially directional outer end of the arm of the paddle during rotation of the paddle is represented as A, and a shortest distance between the rotation locus and the outer circumferential surface of the photosensitive drum is represented as B, and wherein $0.1<B/A<0.3$.

22. The image forming apparatus according to claim 18, further comprising a scraped toner receiver which receives the scraped toner scraped by the scraper from the arm of the paddle.

23. The image forming apparatus according to claim 18, wherein the scraper comprises a scraped toner receiver which receives the scraped toner scraped by the scraped from the arm of the paddle.

24. The image forming apparatus according to claim 23, wherein:

the cleaner further includes a container containing the blade, the paddle, the scraper and the scraped toner receiver, and the scraper has a base portion fixed on the container and an intermediate portion between the base portion and the free end, and the free end of the scraper is positioned above at least the intermediate portion in the container.

* * * * *